US005950264A

United States Patent [19]

Wyner et al.

[11] Patent Number: 5,950,264

[45] **Date of Patent: *Sep. 14, 1999**

[54] BEDDING ARTICLES ENCLOSED IN ELASTIC LAMINATED WATERPROOF MOISTURE-PERMEABLE ALLERGEN BARRIERS

[75] Inventors: Daniel M. Wyner, North Scituate, R.I.; Annette H. Miller, Ridgefield, Conn.

[73] Assignee: Allergy Control Products, Inc., Ridgefield, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/741,329

[22] Filed: Oct. 28, 1996

Related U.S. Application Data

[63] Continuation of application No. 08/207,479, Mar. 4, 1994, abandoned.

[51] Int. Cl.[6] ..... A47G 9/02

[52] U.S. Cl. ..... 5/690; 5/490; 5/636

[58] Field of Search ..... 123/230, 243; 418/185, 186, 255

[56] References Cited

U.S. PATENT DOCUMENTS

| | | | |
|---|---|---|---|
| 4,539,057 | 9/1985 | Ahlm | 5/473 |
| 4,761,324 | 8/1988 | Rautenberg et al. . | |
| 5,007,123 | 4/1991 | Salyards | 5/473 |
| 5,050,256 | 9/1991 | Woodcock . | |

FOREIGN PATENT DOCUMENTS

| | | |
|---|---|---|
| 0 007 535 A1 | 7/1979 | European Pat. Off. . |
| 618326 | 5/1926 | France . |
| 609464 | 7/1926 | France . |
| 21 02 694 C3 | 8/1972 | Germany . |
| 21 67 283 C2 | 8/1972 | Germany . |

OTHER PUBLICATIONS

Tim Woodbridge, "Breathability–Fact and Fiction", *The New Nonwovens World Fall* 1993, pp. 59–68.

Brigitte Ehnert, MD et al., "Reducing domestic exposure to dust mite allergen reduces bronchial hyperreactivity in sensitive children with asthma", *The Journal of Allergy and Clinical Immunology*, vol. 90, No. 1, pp. 135–138 (Jul. 1992).

Thomas A.E. Platts–Mills et al., "Dust mite allergens and asthma–A worldwide problem*", *The Journal of Allergy and Clinical Immunology*, vol. 83, No. 2, Pt. 1, 416–427 (Feb. 1989).

Witcoflex Super Dry, The Ultimate Breathability, Baxenden Chemicals Ltd. (brochure).

*Primary Examiner*—Michael J. Milano

*Attorney, Agent, or Firm*—Darby & Darby

[57] ABSTRACT

Bedding articles which are encased (or of which all or part of the upholstery is enclosed) in an allergen barrier. The allergen barrier comprises an elastic stretch knit substrate laminated with a monolithic, hydrophilic, moisture-vapor permeable elastic film made from at least one polymer and having a thickness of no more than 1 mil.

8 Claims, No Drawings

BEDDING ARTICLES ENCLOSED IN ELASTIC LAMINATED WATERPROOF MOISTURE-PERMEABLE ALLERGEN BARRIERS

This is a continuation of application Ser. No. 08/207,479, filed Mar. 4, 1994, now abandoned

FIELD OF THE INVENTION

The present invention relates to an improvement in bedding articles which are encased (or of which all or part of the upholstery is enclosed) in an allergen barrier.

BACKGROUND OF THE INVENTION

It has long been established that house mites (family Pyroglyphidae) are a source of house dust allergens that not only cause allergies but also adversely contribute to other pathologies, such as asthma. It has also been established that use of allergen control measures is effective in controlling these conditions. Allergen-proof encasing to contain mites to prevent allergen egress has long been used in bedding (mattresses, pillows, duvets, bed upholstery).

To the extent that such encasing comes in direct or indirect (i.e. through the bed sheets or pillowcase) contact with the human body, it is important that it be pleasant to the touch and moisture-vapor permeable. For aesthetic as well as for comfort reasons, it is important that the material have a good drape and not feel stiff. The prior art has variously attempted to solve these problems. For example:

Since about 1984, Allergy Control Products, Inc. has marketed bedding article encasings (e.g. mattress, tickings, pillow casings, and comforter covers) made of a cotton-polyester blend nonstretchable woven fabric (BOUNCE from Springs Mills, S.C.) laminated with a polyether polyurethane film (DEERFIELD 6100S) 1 mil thick. The lamination process for this material did not involve any stretching of either the film or the (nonstretch) substrate. These bedding article encasings had a moisture vapor transmission of about 100 to about 200 $g/m^2/day$ when measured by ASTM E-96 (Procedure (B), "upright cup"). More recently, the same company has marketed bedding encasings made of a stretch-knit fabric (ADELE circular knit no. 8775, Adele Knits, Winston-Salem, N.C.) and laminated with a 1.0 mil thick film of a polyether polyurethane designated DURE-FLEX 6100S (available from Deerfield Urethane Inc., South Deerfield, Mass.).

These later-commercialized encasings had the advantage of being elastic and provided a better fit. They also had a moisture vapor transmission of about 100–200 $g/m^2/day$ (ASTM E-96). However, the drape of these encasings was still unsatisfactory.

U.S. Pat. No. 5,050,256 discloses bedding systems for mite-induced allergy control enclosed in a barrier material of polyurethane coated (not laminated) woven (nonstretch) fabric that is said to have high water vapor transmission properties. Coated materials suffer from the fact that the coating substance penetrates the fabric and causes it to stiffen. In addition, a relatively high amount of coating must be used to completely cover the fibers of the fabric (thus assuring allergen-barrier properties) which further compounds the stiffness (unsatisfactory drape) problem. Finally, it is not advisable to coat a stretch substrate because of difficulties in controlling the stretch knit under the coating head and because the coating interferes with the stretch properties of the material.

SUMMARY OF THE INVENTION

The invention is directed to improved bedding articles encased in an allergen barrier. The barrier is made from an elastic stretch knit fabric laminated with a monolithic, hydrophilic, highly moisture-vapor permeable, highly elastic film made from a polymer or polymer blend. The film is less than 1 mil thick (and preferably less than or equal to 0.8 mil thick). This material provides a dramatically improved drape and has a substantially improved elasticity, and desirable "slip" properties, while maintaining allergen-barrier properties and a high moisture vapor transmission. The encased article is allergen-proof and substantially more comfortable and pleasant to the touch compared to articles of the prior art.

DESCRIPTION OF THE PREFERRED EMBODIMENTS

As used herein the term: "bedding articles" includes, mattresses, pillows, cushions, comforters, upholstered portions of beds (such as headboards) or sofas or arm chairs and in general any item or component of bedding which in the absence of an allergen proof casing would serve as a habitat for dust mites and would allow mite allergens to come in contact with susceptible human or animal subjects. "Monolithic film" means continuous non porous film.

A preferred method for producing the laminate elastic material of the present invention is disclosed in U.S. Pat. No. 4,761,324 incorporated by reference in its entirety. Briefly, the substrate and the film to be bonded to it are placed under tension so that they have essentially the same percent elongation and a small amount of adhesive is applied to one of them in a substantially discontinuous manner. The substrate and film are then bonded together and the adhesive is cured. The laminate is then allowed to relax.

Suitable film-forming polymers for the present invention include polymers and polymer blends which have been specifically modified to be hydrophilic and which yield films $\leqq 1.0$ mil thick that will have adequate durability adapted to the use of the article (e.g. can withstand washing and normal use) and at least adequate breathability (moisture vapor transmission) and will not be tacky (have good slip). Non-limiting examples of suitable polymers are Dupont's hydrophilic copolyester elastomers (e.g. copolyether ester products such as butylene/poly(alkylene ether) phthalate sold under the designation HYTREL 8171, 8206 and 4778 and available from DuPont Polymer Products, Wilmington, Del. and polymer blends of these products (e.g. 80% 8171 and 20% 8206); hydrophilic elastic polyurethanes and polyurethane blends such as those sold by Morton International (e.g. Morthane PB363, an aliphatic thermoplastic polyurethane) or BF Goodrich, or blends thereof, or blends of one or more of these materials (e.g. a proprietary hydrophilic polyurethane blend made by Porvair Ltd. Kings Lynn, England and sold under the designation PIV) or blends of one or more of these polyurethane materials with one or more copolyester elastomers (e.g. 85% 8171 and 15% Morthane PB363). The relative amounts of each component in the foregoing blends can be optimized but such optimization is well within the skill in the art. For example if a polymer does not yield films with satisfactory slip, it can be blended with a less tacky polymer to reduce tackiness and improve slip.

Suitable films should display at least 150% elongation. The moisture vapor transmission of such films is much higher than that of prior art films used in laminates with stretch substrates, typically about 400–700 $g/m^2/day$ (ASTM E-96 second procedure, upright up method).

Suitable stretch knit substrates for use in the invention include any lightweight stretch knit fabric (warp knit or circular knit) suitable for proximity to the human body. A typical useful weight range for these substrates is 1–7 oz/sq. yard, but 2–4 oz/sq. yard is preferred. The stretch properties of these substrates are an elongation of at least about 100% in the cross direction and preferably at least 125%.

Suitable stretch circular knit substrates are available for example from ADELE Inc.; Darlington Fabrics, Westerley, R.I.; Jewel Industries, Winston-Salem, N.C.; warp tricots are available e.g. from Native Textiles in New York City. The stretch knit substrates may contain lycra spandex, if desired and appropriate to the end use of the bedding article.

The elasticity of the hydrophilic film laminated fabric (film thickness ≦1.0 mil) is superior to prior art products. For example, a nonstretch substrate made by Allergy Control Products (1.0 mil thick film; Deerfield 6100 S laminated on Bounce polyester fabric) showed an elongation of only 2–3% when 5 lbs. of pressure stress was applied in the machine direction on a 1×6 inch strip of the material using an INSTRON Model 11 tensile tester; an ADELE knit no. 8775 stretch substrate laminated with the same 6100S film (but 0.8 mil thick) showed an elongation of about 5–7% in response to the same stress; a product obtained from the assignee of U.S. Pat. No. 5,050,256 and believed to have been made in accordance with that patent had an elongation of 2–4% in response to the same stress. By contrast, a Jewel Industries VC101 stretch knit laminated with Porvair PIV (0.5 mil) had an elongation of 12–15% on application of the same stress.

The thinner the film, the softer the feel and drape and comfort level of the casing. Naturally, the film should not be so thin that the integrity of the allergen barrier (or its durability) would be compromised. But films as thin as just under 0.5 mil (10$\mu$) can be successfully employed.

The drape of laminates according to the invention is dramatically improved over that of the prior art. For example, as measured by Thwing Albert Handleometer (see below) laminates suitable for use in the present invention scored below 15 g in one direction and below 7 g in the other direction, whereas the aforementioned prior art products scored as high as 39 g in each direction (for the product believed to be covered by U.S. Pat. No. 5,050,256). Even the 0.8 mil 6100S film laminate on ADELE polyester scored 17 g in the cross direction and 10 g in the machine direction. The materials used to encase the articles according to the present invention have unexpectedly good slip which facilitates the encasing process easier and contributes to the pleasant touch of the encased bedding articles.

Bedding articles in accordance with the invention have a casing made of the laminated stretch knit fabric, preferably with the film surface facing away from the user. Seams can be finished with binding, or can be sealed using a suitable sealing substance, such as liquid urethane, but neither measure is necessary. In fact, zipper closures can be used. These articles provide effective allergen barriers, as is illustrated below. In addition, the water-proof (or at least water-resistant) properties of the film are particularly beneficial in protecting the encased bedding article from stains.

The Examples below serve to illustrate the present invention without limiting its scope.

EXAMPLES

Example 1

0.8 MIL THICK FILM LAMINATE BEDDING ARTICLE

VC101 stretch knit polyester from Jewel Industries was laminated with a 0.5 mil Porvair PIV film according to the procedure of U.S. Pat. No. 4,761,324 using the same discretely applied crosslinking urethane adhesive. Both the film and the substrate were elongated by the same percentage prior to binding. The resulting laminate had a drape of 12 g in the cross direction and 3 g in the machine direction (measured by Thwing Albert Handleometer Thwing Albert, Philadelphia, Pa. having a 10 mm slot size). The laminate elongated by 12–15 on application of 5 lbs. of stress as described above.

Example 2

ALLERGEN-PROOF PROPERTIES OF BEDDING ARTICLES

Since mattresses, pillows, comforters and upholstered materials act as foci of dust mite growth, an effective allergen barrier encasing these textiles should prevent the egress of both mites and mite-associated allergens.

To test the effectiveness of the stretchable, vapor permeable allergen barrier of the invention, a DACRON pillow was inoculated with 20 gm of D.pteronissinus culture containing nutrients and kept at 75%RH and 75° F. (optimal growth conditions for dust mite growth). After 7 days the pillow was cut in two sections. Section A was then encased in the stretchable, vapor permeable allergen barrier prepared according to Example 1 which was closed with a zipper closure and section B was returned to its original fabric covering.

Samples for dust allergen analysis were collected by vacuuming each section for 2 minutes and were assayed by ELISA (commercially available test from Vespa Laboratories, Inc., Spring Mills, Pa. 16875, Division of ALK, U.S. and having a sensitivity of less than 0.002 $\mu$g/g) for content of Der pI and Der fI (Group I) allergen levels. The section A dust sample did not contain measurable allergen while section B (not encased) had 6170.4 $\mu$g/g of Group I allergens. It should be noted that ≧2 $\mu$g/g of Group I allergens are enough to sensitize susceptible humans and ≧10 $\mu$g/g are enough to trigger symptoms.

A person of ordinary skill in the art will readily appreciate that the invention has been described above with reference to preferred embodiments and that many additions, omissions and modifications are possible, all within the scope of the claims set forth below.

What is claimed is:

1. A bedding article comprising at least one portion which constitutes a habitat for dust mites, said at least one portion being encased in a moisture-vapor permeable allergen barrier layer comprising an elastic stretch knit substrate laminated with a monolithic, hydrophilic, moisture-vapor permeable elastic film made from at least one polymer and having a thickness of no more than 1 mil, wherein said laminate, as measured at a thickness of 0.8 mil, has a moisture vapor transmission in excess of 400 g/m$^2$/day upon measurement at about 75° F. using the ASTM E96, second procedure, upright cup method, and further wherein said laminate, as measured at a thickness of 0.8 mil, has a drape below 15 g in one direction and below 7 g in the other direction as measured by a handleometer with a 10 mm slot size, said barrier layer preventing the egress of dust mites and dust mite associated allergens from said bedding article.

2. The article of claim 1, said article being selected from the group consisting of mattresses, pillows, cushions, comforters, and upholstered portions of beds, sofas and armchairs.

3. The article of claim 1, wherein said film has a thickness of 0.8 mil.

4. The article of claim 1, wherein said film has a thickness of 0.5 mil.

5. The article of claim 1, wherein said substrate has a weight within the range of 1–7 oz./sq. yard.

6. The article of claim 1, wherein said substrate has a weight within the range of 2–4 oz./sq. yard.

7. The article of claim 1, wherein said polymer is selected from the group consisting of hydrophilic copolyester elastomers, hydrophilic elastic polyurethanes and blends of two or more of the foregoing.

8. A bedding article comprising at least one portion which constitutes a habitat for dust mites, said at least one portion being encased in a moisture-vapor permeable allergen barrier layer comprising an elastic stretch knit substrate laminated with a monolithic, hydrophilic, moisture-vapor permeable elastic film made from at least one polymer and having a thickness of no more than 1 mil, wherein said laminate, as measured at a thickness of 0.8 mil, has a moisture vapor transmission in excess of 400 $g/m^2$/day upon measurement at about 75° F. using the ASTM E96, second procedure, upright cup method, further wherein said laminate, as measured at a thickness of 0.8 mil, has a drape below 15 g in one direction and below 7 g in the other direction as measured by Thwing Albert Handleometer with a 10 mm slot size, further wherein said polymer is selected from the group consisting of hydrophilic copolyester elastomers, hydrophilic elastic polyurethanes and blends of two or more of the foregoing, and further wherein prior to lamination said film has an elasticity of at least 150% and said substrate has an elasticity in the cross direction of at least about 100%, said barrier layer preventing the egress of dust mites and dust mite associated allergens from said bedding article.

* * * * *